US006840150B1

(12) United States Patent
Davis

(10) Patent No.: US 6,840,150 B1
(45) Date of Patent: Jan. 11, 2005

(54) DEVICE AND METHOD FOR SAFELY REMOVING THE SPINDLE AND THE BREECHBLOCK FROM THE CARRIER OF AN M777 HOWITZER

(75) Inventor: Terry L. Davis, Yuma, AZ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/690,910

(22) Filed: Oct. 23, 2003

(51) Int. Cl.[7] ..... B64D 1/04
(52) U.S. Cl. ..... 89/1.1; 89/25
(58) Field of Search ..... 89/1.1, 17, 25; 280/87.051; 482/66, 68

(56) References Cited

U.S. PATENT DOCUMENTS 4,716,811 A * 1/1988 Johnson ..... 89/40.12
5,447,319 A * 9/1995 Huang ..... 280/87.051
5,518,475 A * 5/1996 Garland ..... 482/68
5,743,839 A * 4/1998 Niskanen ..... 492/20
6,142,261 A * 11/2000 Yang ..... 188/20
6,223,643 B1 5/2001 Muller

FOREIGN PATENT DOCUMENTS

GB 2287186 A * 9/1995 ..... A47D/9/00

OTHER PUBLICATIONS

FAS Military Analysis Network: XM777 Lightweight 15mm howitzer (LW155), Dec. 15, 1998.*

* cited by examiner

*Primary Examiner*—Michael J. Carone
*Assistant Examiner*—Troy Chambers
(74) *Attorney, Agent, or Firm*—Alan P. Klein

(57) ABSTRACT

A stool-like device for safely removing the spindle and the breechblock from the carrier of a howitzer. The device comprises a frame; rollers connected to the frame for sliding the bottom of the frame on the recoil slide rails of a howitzer until the frame is centered under the breechblock of the howitzer; and plates connected to the frame for receiving and holding the breechblock while permitting passage of the spindle through holes in the plates so that the spindle can be safely removed from the carrier of the howitzer without the breechblock dropping out of the carrier and causing bodily harm. After the spindle is removed, the breechblock can also be removed by raising the carrier and sliding the device out from under it.

13 Claims, 4 Drawing Sheets

DEVICE AND METHOD FOR SAFELY REMOVING THE SPINDLE AND THE BREECHBLOCK FROM THE CARRIER OF AN M777 HOWITZER

BACKGROUND OF THE INVENTION

This invention relates in general to ordnance and more particularly, to breech loading guns.

In the past, removal of the spindle and the breechblock from the carrier of the M777 LW 155 lightweight howitzer, after the howitzer was fired, has been a cumbersome and potentially harmful procedure. Because of the inherent design requirements of the howitzer, the physical space available to maintenance personnel is limited to one technician. The weight of the spindle and the breechblock —in excess of 100 pounds—require additional personnel to assist the technician in the removal or installation of the spindle and the breechblock. Due to the limited workspace, there is a potential for bodily harm being inflicted on maintenance personnel in the process.

SUMMARY OF THE INVENTION

It is therefore an object of this invention to permit the spindle holding the breechblock in the carrier of a howitzer and the breechblock to be safely removed from the carrier by a single person without requiring assistance from additional personnel.

This and other objects of the invention are achieved in one aspect by a device comprising a frame; centering means for sliding the bottom of the frame on the recoil slide rails of the howitzer until the frame is centered under the breechblock of the howitzer; and receiving means connected to the frame for receiving and holding the breechblock while permitting passage of the spindle th rough the receiving means so that the spindle can be safely removed from the carrier without the breechblock dropping out of the carrier and causing bodily harm.

Another aspect of the invention involves a method comprising the steps of lifting a stool-like device onto the recoil slide rails of the howitzer; sliding the device on the recoil slide rails of the howitzer until the device is centered under the breechblock of the howitzer; receiving and holding the breechblock on top of the device while permitting passage of the spindle through a hole in the device; and removing the spindle from the carrier without the breechblock dropping out of the carrier and causing bodily harm. After the spindle is removed, the breechblock can also be removed by raising the carrier and sliding the device out from under it.

Additional advantages and features will become more apparent as the subject invention becomes better understood by reference to the following detailed description when considered in conjunction with the accompanying drawings wherein:

DETAILED DESCRIPTION

Figure 1:
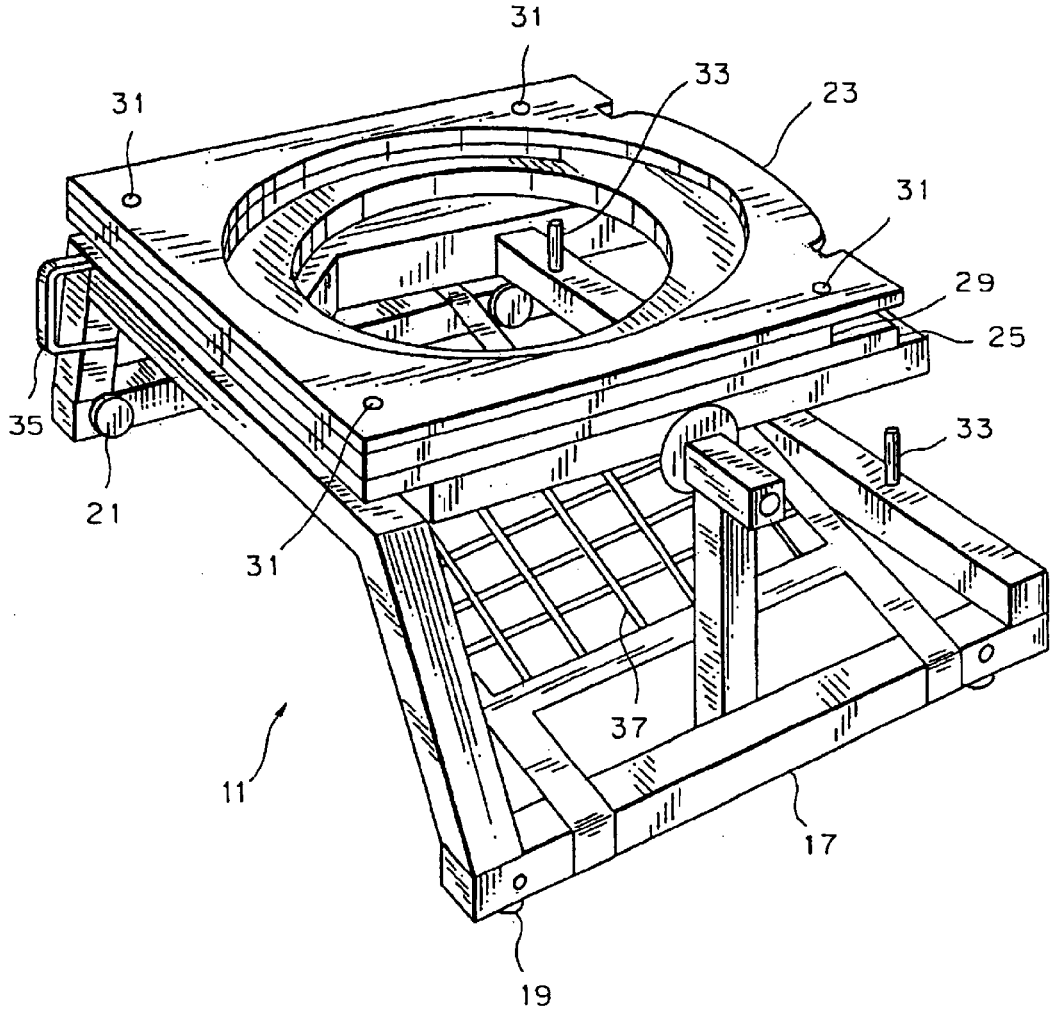
FIG. 1 is a perspective view of the device of the present invention.
Figure 2:
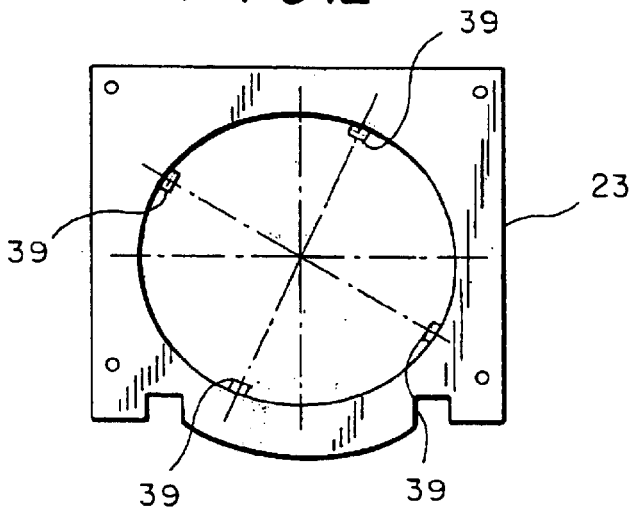
FIG. 2 is a top plan view of the top plate.
Figure 3:
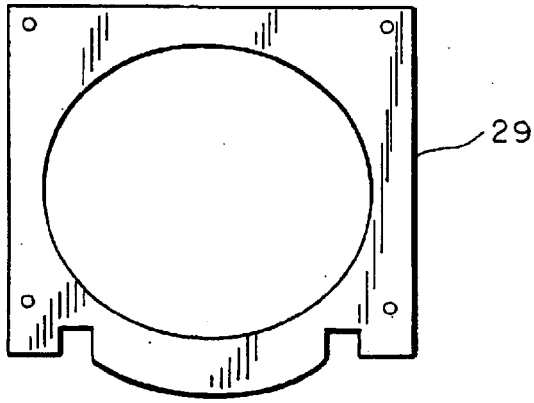
FIG. 3 is a top plan view of the spacer plate.
Figure 4:
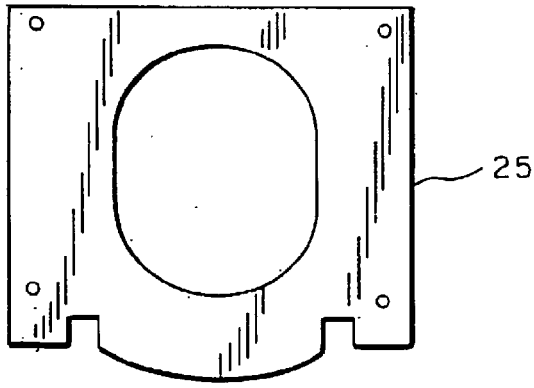
FIG. 4 is a top plan view of the bottom plate.
Figure 5:
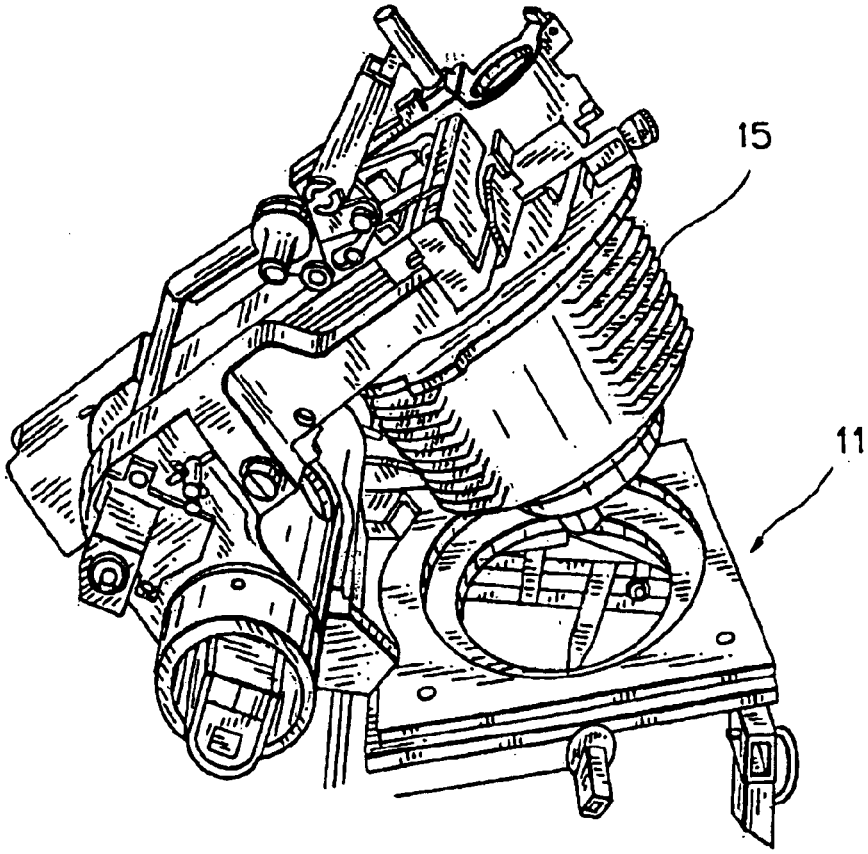
FIG. 5 is a perspective view of the device being positioned.
Figure 6:
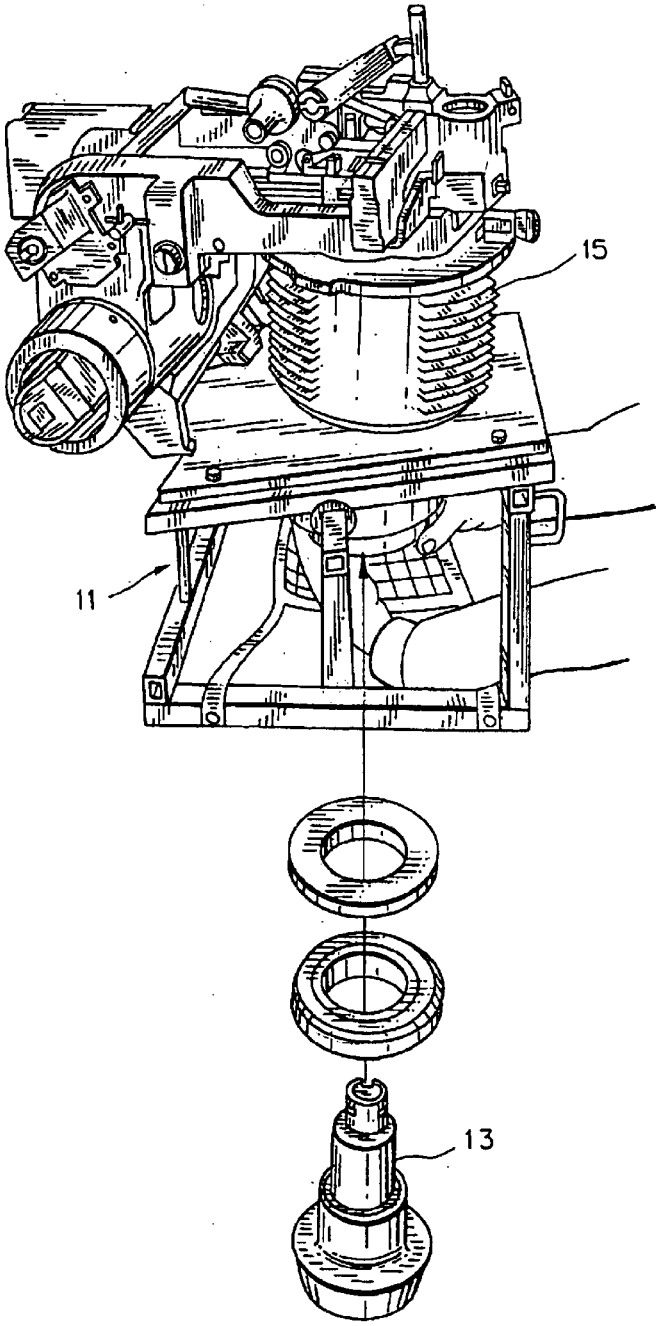
FIG. 6 is an exploded perspective view of the breechblock, spindle and device.

Referring now to the drawings, wherein like reference numerals designate identical or corresponding parts, FIGS. 1–6 show a stool-like device 11 for safely removing the spindle 13 holding the breechblock 15 in the carrier of a howitzer (not shown) to be safely removed from the carrier. The howitzer has a set of recoil slide rails (not shown) to permit the howitzer to kick back when the howitzer is fired. The device 11 includes a hollow frame 17, a centering means for sliding the bottom of the frame on the recoil slide rails of the howitzer until the frame is centered under the breechblock 15 of the howitzer, and a receiving means connected to the frame 17 for receiving and holding the breechblock 15 while permitting passage of the spindle 13 through the receiving means so that the spindle can be safely removed without the breechblock dropping out of the carrier and causing bodily harm.

While the centering means may take a variety of forms, conveniently it may take the form of a set of rollers 19 connected to the hollow frame 17, the upper parts of the rollers being disposed inside the frame, and a set of rail guides 21 disposed outside of the hollow frame and covering the lower parts of the rollers.

While the receiving means may take a variety of forms, conveniently it may take the form of a top plate 23, a bottom plate 25 pivotably connected to the framc 17, a spacer plate 29 inserted between and fastened to the bottom plate and the top plate by bolts 31, a pair of stops 33 disposed in the frame, a locking pin 35 connected to the frame, and a safety net 37 attached to the frame beneath the bottom plate. The top plate 23 has a hole in it, the bottom plate 25 has a smaller hole in it aligned with the hole in the top plate, and the spacer plate 29 has a hole in it that matches the hole in the top plate and is aligned with the hole in the top plate and with the hole in the bottom plate. Four alignment lugs 39 are provided around the hole of the top plate 23.

In operation, after the howitzer is fired, the frame 17 is lifted and the rollers 19 are placed on the recoil slide rails so that the rail guides 21 protect the lower parts of the rollers and guide the frame on the rails. The rollers are slid on the slide rails until the frame 17 is centered under the breechblock 15 of the howitzer. Next, the bottom plate 25 is pivoted against the stops 33 so that the top plate 23 is oriented to receive and hold the breechblock 15 while passing the spindle 13 through the bottom plate 25 and then is locked in position with the locking pin 35. The spindle 13 may then be removed from the carrier of the howitzer for inspection and cleaning, without the possibility of the breechblock dropping out of the carrier and injuring the maintenance technician. If the spindle is dropped the safety net 37 will catch it. After the spindle 13 is removed, the breechblock can also be removed by raising the carrier and sliding the device 11 out from under it. When the spindle 13 is replaced in the carrier after inspection and cleaning, the lugs 39 ensure it is properly oriented.

It is obvious that many modifications and variations of the present invention are possible in light of the above teachings. It is therefore to be understood that within the scope of the appended claims, the invention may be practiced otherwise than as described.

What is claimed as new and desired to be secured by Letters Patent of the United States is:

1. A device for safely removing the spindle holding the breechblock in the carrier of a howitzer, the howitzer having a set of recoil slide rails to permit the howitzer to kick back when fired, the device comprising:

a frame;

centering means for sliding the bottom of the frame on the recoil slide rails of the howitzer until the frame is centered under the breechblock of the howitzer; and receiving means connected to the frame for receiving and holding the breechblock while permitting passage of the spindle through the receiving means so that the spindle can be safely removed without the breechblock dropping out of the carrier and causing bodily harm.

2. The device recited in claim 1 wherein the centering means includes:

a plurality of rollers connected to the frame.

3. The device recited in claim 2 wherein the frame is hollow.

4. The device recited in claim 3 wherein the upper parts of the rollers are disposed inside the hollow frame.

5. The device recited in claim 4 wherein the centering means includes:

a plurality of rail guides disposed outside of the frame and covering the lower parts of the rollers for guiding the frame on the rails.

6. The device recited in claim 1 wherein the receiving means includes:

a top plate having a hole for receiving and holding the breechblock of the howitzer.

7. The device recited in claim 6 wherein the receiving means includes a bottom plate pivotably connected to the frame and having a hole aligned with the hole in the top plate to permit the spindle to pass through the bottom plate.

8. The device recited in claim 7 wherein the receiving means includes:

a spacer plate inserted between and fastened to the top plate and to the bottom plate and having a hole aligned with the hole in the top plate and the hole in the bottom plate.

9. The device recited in claim 8 wherein the receiving means includes:

a stop disposed in the frame to limit the pivoting of the bottom plate.

10. The device recited in claim 7 wherein the receiving means includes:

a safety net attached to the frame beneath the bottom plate to catch the spindle.

11. The device recited in claim 1 in combination with a howitzer.

12. A device for safely removing the spindle holding the breechblock in the carrier of a howitzer, the howitzer having a set of recoil slide rails to permit the howitzer to kick back when fired, the stool comprising:

a hollow frame;

a plurality of rollers connected to the frame for sliding the frame on the recoil rails of the howitzer until the frame is centered under the breechblock of the howitzer, the upper parts of the rollers being disposed inside the hollow frame;

a plurality of rail guides disposed outside the frame and covering the lower parts of the rollers for guiding the frame on the rails;

a top plate having a hole for receiving and holding the breechblock of the howitzer;

a bottom plate pivotably connected to the frame and having a hole aligned with the hole in the top mounting plate to permit the spindle to pass through the bottom plate;

a spacer plate inserted between and fastened to the top plate and to the bottom plate and having a hole aligned with the hole in the top plate and the hole in the bottom plate;

a stop disposed in the frame to limit the pivoting of the bottom plate;

means for locking the bottom plate in position; and a safety net attached to the frame beneath the bottom plate to catch the spindle if dropped when the spindle is removed from the carrier and lowered through the hole in the bottom plate, the breechblock being prevented from dropping out of the carrier and causing bodily harm.

13. The device recited in claim 12 in combination with a howitzer.

* * * * *